US010457085B2

(12) United States Patent
Bodziak et al.

(10) Patent No.: US 10,457,085 B2
(45) Date of Patent: Oct. 29, 2019

(54) ASSEMBLY FOR DISPENSING FULL ADHESIVE NOTES

(71) Applicant: 3M INNOVATIVE PROPERTIES COMPANY, St. Paul, MN (US)

(72) Inventors: Douglas P. Bodziak, Lake Elmo, MN (US); Traxton J. Turner, Maplewood, MN (US); Gerald E. Mueller, Eagan, MN (US); Jordan C. DuCharme, Apple Valley, MN (US); Daniel J. Tipping, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/069,534

(22) PCT Filed: Feb. 20, 2017

(86) PCT No.: PCT/US2017/018599
§ 371 (c)(1),
(2) Date: Jul. 12, 2018

(87) PCT Pub. No.: WO2017/147028
PCT Pub. Date: Aug. 31, 2017

(65) Prior Publication Data

US 2019/0023053 A1 Jan. 24, 2019

Related U.S. Application Data

(60) Provisional application No. 62/298,276, filed on Feb. 22, 2016.

(51) Int. Cl.
*B42D 5/00* (2006.01)
*B65D 83/08* (2006.01)

(52) U.S. Cl.
CPC ..... *B42D 5/005* (2013.01); *B42D 5/003* (2013.01); *B65D 83/08* (2013.01)

(58) Field of Classification Search
CPC ..... B42D 5/005; B42D 5/003; B42D 5/008; B65D 83/08; B42F 17/00; B42F 17/18;
(Continued)

(56) References Cited

U.S. PATENT DOCUMENTS 2,464,426 A * 3/1949 Williams ..... B65D 83/12 15/210.1
4,416,392 A * 11/1983 Smith ..... A47K 10/422 206/39.7

(Continued)

FOREIGN PATENT DOCUMENTS

DE 202004004537 6/2004

OTHER PUBLICATIONS

PCT International Search Report from PCT/US2017/018599 dated Mar. 31, 2017, 5 pages.

*Primary Examiner* — Jennifer E. Novosad
(74) *Attorney, Agent, or Firm* — Eric E. Silverman

(57) ABSTRACT

An assembly for dispensing full adhesive notes comprising: a pad comprising a plurality of full adhesive notes arranged in a dispensing stack; and a retention surface comprising a mounting face and adjacent recessed portion; wherein the adhesive on the bottommost note is adhered to the mounting face and portions of the note extend beyond the mounting face.

14 Claims, 3 Drawing Sheets

(58) Field of Classification Search
CPC .... A47F 7/142; A47F 1/00; A47F 1/04; A47F 1/12; A47K 10/44; A47K 10/42; A47K 10/421; A47K 2010/428
USPC ..... 211/50, 51; 221/303, 309, 83, 45, 52, 221/46, 48, 49, 55; 206/449; 312/61
See application file for complete search history.

(56) References Cited

U.S. PATENT DOCUMENTS 4,586,631 A * 5/1986 Loder ..... B65D 83/0805 221/58
4,770,320 A * 9/1988 Miles ..... B42D 5/005 206/39.3
4,781,306 A * 11/1988 Smith ..... A47K 10/422 206/39.7
4,796,781 A * 1/1989 Windorski ..... B42D 5/005 221/45
4,921,127 A 5/1990 Windorski
4,986,440 A * 1/1991 Windorski ..... B42D 5/005 221/45
5,067,628 A * 11/1991 Evenson ..... B42D 5/005 221/52
5,080,254 A * 1/1992 Feer ..... B42D 5/005 206/215
5,143,250 A * 9/1992 Freitag ..... B42D 5/005 221/154
5,167,346 A * 12/1992 Bodziak ..... B42D 5/005 221/185
5,363,985 A * 11/1994 Cornell ..... B42D 5/005 221/46
5,397,117 A * 3/1995 Mertens ..... B42D 5/005 221/33
5,607,067 A * 3/1997 Morrissey ..... B42D 5/005 206/215
6,068,157 A * 5/2000 Kamiya ..... B65H 1/12 221/259
6,514,585 B1 * 2/2003 Pearson ..... G09F 3/10 428/40.1
6,749,084 B2 * 6/2004 Thompson ..... B42D 5/005 221/56
7,118,008 B2 * 10/2006 Hsu ..... B65D 83/0805 221/45
8,261,937 B2 * 9/2012 Bodziak ..... B42D 5/006 206/39.3
2001/0025801 A1 * 10/2001 Hurwitz ..... B42D 5/005 206/215
2003/0168468 A1 9/2003 Thompson
2003/0178437 A1 * 9/2003 Crawford ..... B42D 5/005 221/45
2006/0261077 A1 * 11/2006 Bodziak ..... B42D 5/005 221/33
2007/0175913 A1 * 8/2007 O'Leary ..... B42D 5/005 221/34
2008/0093835 A1 * 4/2008 Sward ..... B42D 5/005 281/21.1
2008/0237254 A1 * 10/2008 Liu ..... B65H 1/04 221/45
2009/0050646 A1 * 2/2009 Windorski ..... B42D 5/005 221/33
2009/0057361 A1 3/2009 Jour
2019/0023053 A1 * 1/2019 Bodziak ..... B65D 83/08

* cited by examiner

ASSEMBLY FOR DISPENSING FULL ADHESIVE NOTES

FIELD

The present invention relates to dispensers for self-adhesive sticky notes, in particular for so-called "full adhesive" notes (i.e., notes in which the major portion of the rear surface have adhesive thereon).

BACKGROUND

Self-adhesive sticky notes (e.g., Post-it® Notes) are found in homes, offices, classrooms, and other work locations around the world. In common embodiments, such notes comprise a paper sheet with a stripe of adhesive on the back face. Typically the adhesive stripe is located at one edge of the note. In some embodiments, the adhesive stripe is located near the middle of the back face of the note.

Self-adhesive sticky notes are typically sold in stacks or pads in which overlying notes are adhered to underlying notes by the adhesive on the back face of the overlying note. The bottom most note is commonly adhered to a removable back sheet.

To increase the strength with which a self-adhesive note sticks to a desired surface, so-called "full adhesive" notes have been introduced. The back face of such notes is substantially completely covered with adhesive, but for one or more corner portions or an edge stripe which is free of adhesive to facilitate grasping and removal of the top most note from the pad. One illustrative commercial embodiment is a pad of about 25 to about 30 notes with a nominal 3 inch square (7.7 cm) format in which the entire back side of each note is covered with adhesive except for a single stripe having a width of about ⅜ inch (0.9 cm) along one edge.

One common dispenser format for self-adhesive sticky notes is to remove the back sheet, if any, and adhere the bottom most note to a selected location (e.g., a flat panel, note book cover, etc.). In simplest approach, pads may be stuck directly to flat surfaces such as the cover of a notebook computer, notebook cover, divider panel in a notebook, or work surface. In some instances, a dispenser is used which comprises a flat receiving panel to which pad is self-adhered. In some instances, the area of the receiving panel is surrounded, at least in part, by one or more upright panels or walls to protect the pad from lateral impacts and other unwanted wear and tear.

A challenge with paper-based full adhesive notes is that under humid conditions the paper sheets tend to absorb moisture from the ambient air. Such absorption causes some dimensional distortion of each sheet, causing the pad to curl. Typically the pad will tend to shift from an initially flat configuration to curl toward the adhesive-coated back side. Such curling tends to cause the pad to disengage from the surface on which the pad is mounted, leading to its loss or damage, inconvenience, mess, etc.

The need exists for assemblies for dispensing full adhesive notes from pads on which the note pads will remain securely mounted.

SUMMARY

The present invention provides an assembly for dispensing full adhesive notes from a pad of such notes. The novel assembly has been found to provide surprisingly stable results, retaining the pad of notes as desired without suffering pop off separation of the pad from the dispenser assembly due to high humidity conditions. As a result, assembled (i.e., loaded with a pad of notes) dispensers exhibit increased product stability and durability during shipping and handling, prior to and during use.

In brief summary, the invention provides assembly for dispensing full adhesive notes comprising a pad of such notes and a dispenser. The pad comprises a plurality of full adhesive notes arranged in a stack from which they may be removed singly. The notes each comprise a sheet having a front face and a back face and have adhesive on at least a portion of the back face.

The dispenser comprises a retention feature adapted to receive and secure the pad. The retention feature comprises a pillar having a mounting face surrounded by a recessed portion. Adhesive on the bottom most note is adhered to the mounting face. The surface area of adhesive portion of the back face of the sheet is greater than the surface area of the mounting face. As secured on the mounting face, the geometric center of the adhesive portion of the back face of the sheet is aligned over the mounting face such that portions of the note extend beyond the mounting face on the entire perimeter of the mounting face.

In some embodiments, the assembly comprises a plurality of such retention surfaces, each with a pad of full adhesive notes adhered to the respective attachment face and portions of the note pad extending beyond the attachment face.

BRIEF DESCRIPTION OF THE DRAWINGS

The invention is further explained with reference to the drawing wherein.

These figures are not to scale and are intended to be merely illustrative and not limiting. Like reference numbers are used for like features. To facilitate understanding of this description, orientation of each FIG. in a common x-y-z orientation system is shown.

DETAILED DESCRIPTION OF ILLUSTRATIVE EMBODIMENTS

Notes/Pad

Figure 1A:
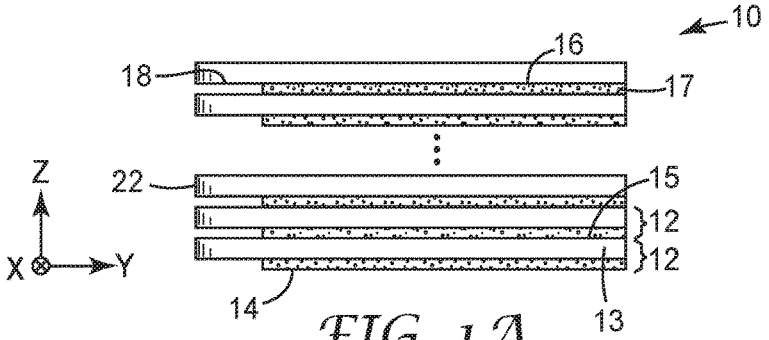
FIG. 1A is a cross section of an illustrative pad of an assembly of the invention.
Figure 1B:
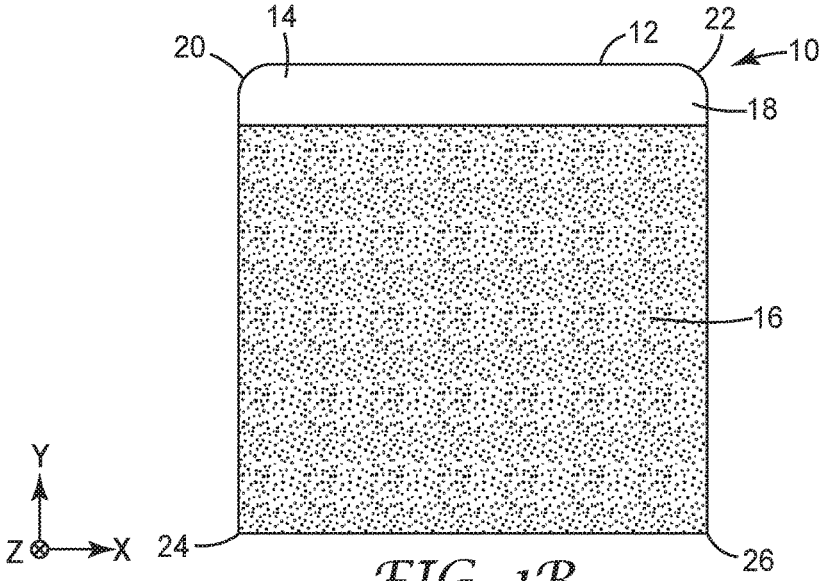
FIG. 1B is a plan view of the bottom face of the pad shown in FIG. 1A.

The invention provides an assembly for dispensing full adhesive notes from a pad in which a plurality of such notes are stacked. Referring to FIGS. 1A and 1B, a typical pad 10 comprises a plurality of notes 12, each comprising a sheet 13. Each note has a front face 15 and back face 14. A major portion 16 of back face 14 of the note has adhesive 17 thereon.

Notes in a pad are typically of the same configuration (e.g., size, shape, and adhesive location) and comprise the same component materials. Notes in a pad are stacked one atop another successively, with the adhesive-bearing back face of a note (i.e., referred to as an "overlying note") releasably adhered to the front face of the next note in the pad (i.e., referred to as an "underlying note"). Pads comprise a selected number of notes, commonly from about 20 to about 30 notes in commercial full adhesive note pads, though pads with other numbers of notes may be used if desired.

Typically, at least one portion 18 of the back face is free of adhesive to facilitate separation of individual sheets from the pad. In this embodiment, non-adhesive portion 18 is in the shape of a stripe extending along an entire edge of the note. To facilitate orientation of the pad for use, release corners 20, 22 corresponding to non-adhesive portion 18 are optionally rounded while opposing corners 24, 26 are squared off. In other embodiments if desired, the non-adhesive portions may be configured in other ways, for instance, at one or more corners or edges of the notes in the pad.

For instance, one illustrative commercial embodiment is a pad of about 25 to about 30 notes with a nominal 3 inch square (7.7 cm) format in which the entire back side of each note is covered with adhesive except for a single stripe having a width of about ⅜ inch (0.9 cm) along one edge.

The adhesive covers the majority of the back face of the sheet, in some embodiments adhesive covers at least about 75 percent of the area of the back face of the sheet, and in some embodiments the adhesive covers at least about 85 percent of the area of the back face of the sheet. Notes with higher adhesive coverage tend to exhibit greater stability when adhered to a desired surface.

Figure 2A:
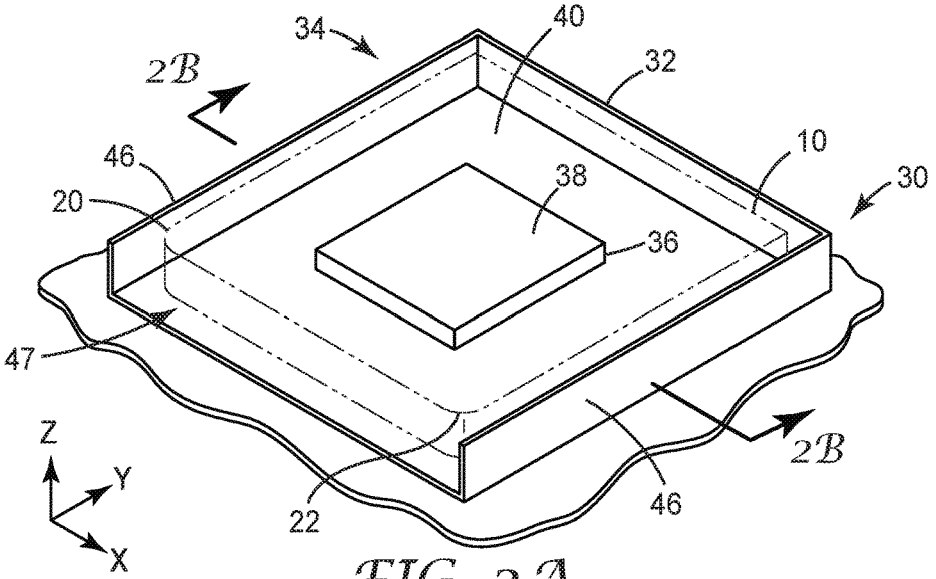
FIG. 2A is a perspective view of a portion of an illustrative dispenser of an assembly of the invention.

Although the notes are commonly substantially rectangular in shape (e.g., substantially square as shown in FIGS. 1B and 2A), the notes may be in any desired shape (e.g., other parallelogram, ovate, circular, or more complex shape).

In some embodiments, the notes have an aspect ratio (i.e., relative dimensions in x and y axes) of from about 2:1 to about 1:2. Notes having configurations outside this range may be used in accordance with the invention.

In typical embodiments, the notes comprise paper (i.e., a sheet of interconnected small, discrete fibers, typically, cellulose-based fibers) plus optional additives, colorants, coatings, etc. Suitable materials are widely known and available for note applications. As used herein, the term "paper" is understood to include a sheet material that contains paper fibers (e.g., cellulose-based), which may also contain other materials (e.g., fillers, colorants, etc.). Suitable paper fibers include natural and synthetic fibers, for example, cellulosic fibers, wood fibers of all varieties used in papermaking, other plant fibers, such as cotton fibers, fibers derived from recycled paper; and synthetic fibers, such as rayon, nylon, fiberglass, or polyolefin fibers. For instance, in the preparation of the paper product, the paper web, or paper material may be reinforced with synthetic fibers, such as nylon or fiberglass, or impregnated with nonfibrous materials, such as plastics, polymers, resins, or lotions. The paper may be a coated, laminated, or composite paper material. The paper can be bleached or unbleached.

Those skilled in the art can readily select and formulate suitable sheet material for the notes. The sheet material should exhibit sufficient strength (e.g., tear strength, dimensional stability) to withstand being grasped and removed from the pad without tearing, shredding, or becoming undesirably stretched out of shape. The sheet material may be of any desired color, often selected in part dependent upon desired writing instruments (e.g., pencils, pens, and markers of select colors).

The front face of the note should be writeable, that is capable of being written on by hand with desired writing instruments (e.g., pencils, pens, and markers). Desired writeability characteristics may be inherent to the sheet material or improved performance may be obtained by treating the sheet material, or at least the top surface thereof, with select additives, coatings, etc. In addition, select additives to the sheet material or coatings on the front face thereof may be used to optimize desired release of overlying notes from underlying notes.

Those skilled in the art can readily select and formulate suitable adhesives for use in note pads used in the invention. The adhesive should be such that adhesive on an overlying note separates cleanly from the underlying note when the overlying note is removed from the pad and then provide desired adhesion for the intended note application (e.g., intended adherends such as metal, glass, plastic, wood, paper, etc.; expected temperature and environmental conditions such as temperature, wind, motion, etc.). In some embodiments, the note is only intended for a single use, of either short or indeterminate duration. In other embodiments, the note is preferably capable of repositioning (i.e., placement on and adhesion to a first adherend or position, followed by, one or more times, removal and placement on and adhesion to a subsequent adherend or position).

Dispenser

Figure 2B:
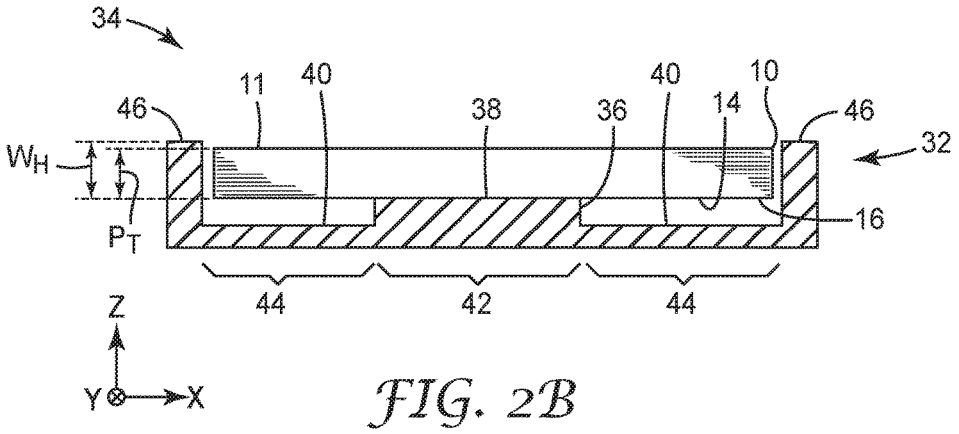
FIG. 2B is a cross section of a portion of the dispenser shown in FIG. 2A with a pad mounted therein.

Referring to FIGS. 2A and 2B, in accordance with the invention, in addition to pad 10 (shown in dotted line in FIG. 2A to permit illustration of other features) assembly 30 comprises dispenser 32 which comprises retention feature 34 adapted to receive and secure pad 10. Retention feature 34 comprises pillar 36 having mounting face 38 surrounded by recessed portion 40. Adhesive on portion 42 of back face 14 of the bottom most note 12 is adhered to mounting face 38.

The retention feature is adapted to receive the pad. In use, the adhesive on the bottom most note is adhered to the attachment face and portions of the note extend beyond the attachment face.

Typically, the surface area of the mounting face is equal to from about 15 percent to about 40 percent of the surface area of the adhesive portion of the notes. In some embodiments, the surface area of the mounting face is equal to from about 20 percent to about 30 percent of the surface area of the adhesive portion of the notes. If the surface area of the mounting face is too low, the pad may tend to be dislodged from the assembly during use, such as when the assembly with pad thereon is moved, turned around or over, etc. If the surface area of the mounting face is too large relative to the surface area of the adhesive portion of the notes (i.e., such that increasingly small portion of the notes extend beyond the mounting face), the note pad will be more likely to pop free from assembly when subjected to changes in environmental conditions (e.g., temperature and humidity).

In an illustrative embodiment, the mounting face has a square configuration with side dimensions of about 1.5 inches×1.5 inches (3.8 cm by 3.8 cm), and the pad comprises sheets having a square configuration with side dimensions of about 3 inches by 3 inches (7.7 cm by 7.7 cm), the back sides of the notes having adhesive covering 3 inch by 2⅝ inch portions (7.7 cm by 6.7 cm) and ⅜ inch (0.9 cm) wide non adhesive portions along one edge. In such embodiment, the area of the mounting face is equal to about 28 percent of the area of the adhesive portion on the back face of the notes.

In typical embodiments, the retention feature is configured such that the pad is positions substantially centrally on the mounting face.

As shown in FIGS. 2*a* and 2*b*, the central portion of the pad 10 is supported on mounting face 38 while portions of pad 10 extend beyond mounting face 38 over recessed portion 40 of retention feature 34. Thus, if pad 10 tends to curve toward the adhesive side in response to environmental changes such as changes in humidity or temperature, as the outer edges of pad 10 distend in that manner, they tend to curl (downward or in the z-axis in the orientation depicted in FIG. 2B) toward the surface of recessed portion 40. Because the relative elevation of mounting face 38 is above that of recessed portion 40, the pad may undergo such curl without overcoming the strength of the bond between adhesive 17 and mounting face 38 which keeps pad 10 bonded to assembly 30.

In the embodiment shown in FIGS. 2A and 2B, the elevation of the entirety of the surface of recessed portion 40 is substantially level and parallel to, but relatively lower, than mounting face 38. In some embodiments, the height of the mounting face is about 0.03 inch (0.8 mm) above (again, in the z-axis) the level of the recessed portion at the perimeter of the notes. In other embodiments, the height of the mounting face is about 0.06 inch (1.5 mm) above the level of the recessed portion at the perimeter of the notes. In still other embodiments, the height of the mounting face is about 0.12 inch (3 mm) above the level of the recessed portion at the perimeter of the notes. If the difference in elevation is too little, pads will tend to pop off when distending in response to environmental conditions, failing to obtain desired benefits of the invention. If the difference in elevation is too high, pads may be subject to being dislodged when portions extending beyond the mounting face are subjected to pressure (e.g., such as when writing on the top most note in the pad).

In some embodiments, the surface of recessed portion 40 is adapted to reduce the degree of adhesion which the adhesive of overlaying portions of pad 10 will develop thereto should they come into contact. For instance, the surface may be roughened, dull, textured, or coated with release agent. In contrast, a strong bond to mounting face 38 is desired. Accordingly, mounting face 38 is typically adapted to bond effectively with the adhesive, such as being smooth to facilitate effective adhesive bonding, or coated with a bond enhancing agent.

In some embodiments, the retention feature comprises one or more peripheral wall segments. These segments may surround only portions of the recessed portion or they may substantially completely surround the recessed portion. Typically at least a portion of the retention surface will be open to permit access to remove sheets from the pad as desired.

In the embodiment shown in FIGS. 2A and 2B, retention feature 34 comprises three optional peripheral wall segments 46. The fourth side of the retention feature is open (wall opening 47) such that release corners 20, 22 and associated non-adhesive covered edges of the notes of pad 10 are accessible. In this embodiment, wall segments 46 extend higher in the z-axis above the plane defined by mounting face 38 than the thickness of pad 10 (i.e., wall height $W_H$ is greater than pad thickness $P_T$). In such configuration, wall segments 46 can better protect pad 10 such as when the assembly is moved or used, or if it is subject to impact from other articles. However, such configuration may make it more difficult to write on the front face of the top most note before removing it from the pad.

In other embodiments, the wall segments, if provided, may be shorter than the pad thickness (i.e., wall height $W_H$ is less than pad thickness $P_T$). In such embodiments, it is typically easier to write on the front face of the top most note before removing it from the pad, though such configurations may tend to provide less protection to the pad.

Figure 4:
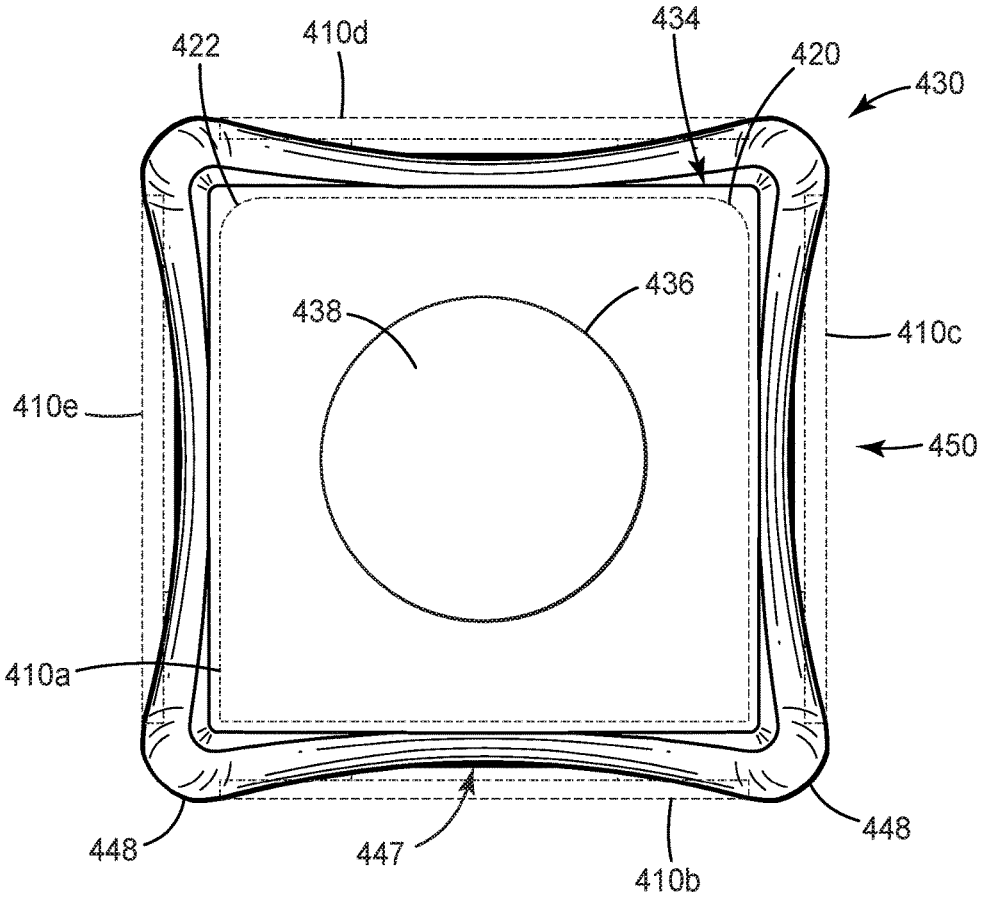
FIG. 4 is a plan view of an illustrative embodiment of an assembly of the invention.

In the embodiment shown in FIG. 4, peripheral wall segments 446 completely surround the recessed portion. In order to permit engagement with and removal of individual notes, at least one of the one or more peripheral wall segments is profiled to have a relatively shorter height at some portion (e.g., wall opening 447) and relatively taller height at another portion (e.g., wall corners 448). Wall openings 447 permit access to the pad to remove sheets from the pad as desired, while relatively higher wall corners 448 and proximate portions of the walls provide protection to the pads and constituent notes. In other embodiments, a smaller (e.g., finger-sized, or thumb-sized) opening corresponding in location to non-adhesive portions of the notes is used.

The invention may be used with pads full adhesive notes having many different shapes, typically some regular rectangle of some selected dimensions but also optionally other straight and rounded sided shapes.

The shape or profile of the attachment face may be a correspondingly smaller version of the notes or different, for instance, attachment faces which are circular, oval, square, rectangular, triangular, etc.

Figure 3A:
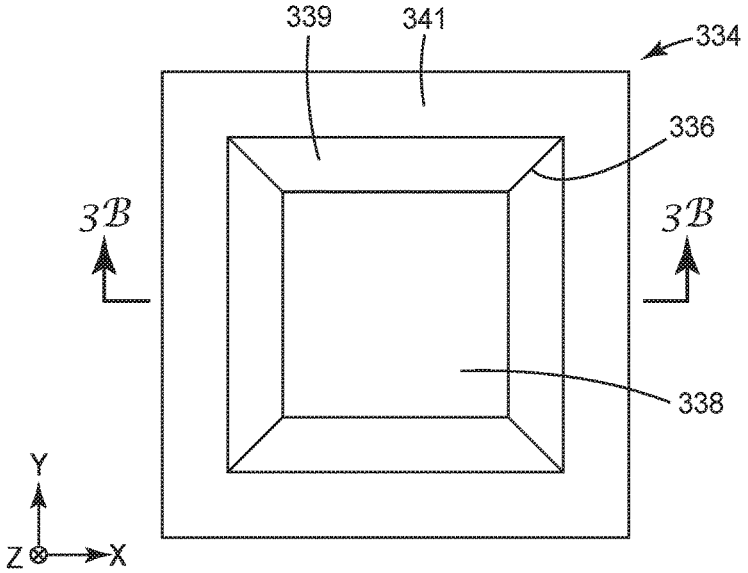
FIG. 3A is a plan view of a portion of the retention feature of another illustrative dispenser of an assembly of the invention.
Figure 3B:
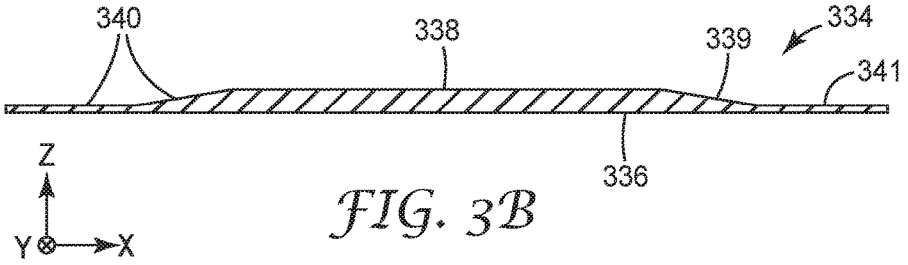
FIG. 3B is a cross section of a portion of the retention feature shown in FIG. 3A.

Notes from pads on dispensers are typically used by either first removing a note from the pad and then writing on it (i.e., after having positioned it on a temporary or final location), or first writing on the note while still on the pad, then removing it and positioning as desired. In some embodiments, the recessed portion and other components of the retention feature may be configured to optimize ease and comfort of writing on the top most note while it is still in situ on the pad coupled with accommodating environmentally induced pad curl. FIGS. 3A and 3B illustrate such an embodiment wherein the degree to which the surface of the recessed portion 340 is recessed below the elevation of mounting face 338 gradually increases from the edge of mounting face 338 to a desired degree at the pad perimeter distance. In the embodiment shown, recessed portion 340 is made up of sloped sides 339 culminating with distal level 341 which is at a constant level (in x-y plane) below mounting face 338 and sloped sides 339. In other embodiments, the elevation or surface profile of the recessed portion may be continuous single straight line extending from the edge of the mounting face to the distal perimeter distance, or it may be somewhat curved, or other configuration. In order to optimize writing on even the last note in a pad (i.e., the one in contact with the mounting face), it is typically preferred that the elevation profile (i.e., the surface level of the recessed portion extending from the edge of the mounting face to at least the point on the surface where the perimeter of the pad extends) be a smooth line.

In some embodiments, the surface of the recessed portion will project at a declination angle of from about 5° to about 15°, typically preferably about 10°, from the plane (i.e., x-y axes) defined by the mounting face. If the declination angle is too little (i.e., such that the difference in relative Z-axis elevation between the mounting face and that of the surrounding recessed portion is too little), the assembly will tend to fail to retain pads as desired. If the declination angle is too great, it may be difficult to write on notes first before removing them from the pad.

The secure and stable mounting which can be achieved with assemblies of the invention permits mounting of pads of notes in many heretofore challenging configurations. For instance, the invention can be used to make a 6 sided assembly with a pad and retention surface on each side as desired. FIG. 4 is a plan view of one side of such an assembly wherein assembly 430 is shown with five pads 410*a*, 410*b*, 410*c*, 410*d*, 410*e*. Each pad is separately mounted to the assembly within a retention feature (e.g., 434) comprising surrounding peripheral walls 446. In this embodiment, peripheral wall segments 446 completely surround retention feature 434 and are profiled with maximum height at the corners and relatively lower height in the middle to permit access to the pads so that a note may be removed therefrom as desired. In this embodiment, pillar 436 is cylindrical in shape such that mounting face 438 is round.

As desired, assemblies of the invention can be made in portable embodiments (e.g., of suitable size, shape, and weight), or as standalone desk top or table top devices (e.g., which are weighted for stability). Assemblies of the invention may further comprise additional features such as optional protective lids or closures which cover and protect the pad and/or retention feature. Assemblies of the invention can be incorporated into other devices and objects (e.g., as a component feature of a utility tray, clip board, or desk top tool carousel). Assemblies of the invention may be made in essentially independent form (e.g., a flat bottom so as to sit in stable manner on a typical flat desk top or table top) or adapted to secure to surfaces or objects as desired (e.g., with adhesive or mechanical fastening means such as clips, screws, etc. so that the assembly can be affixed to a notebook cover or lap top cover).

Reference Number Key

| Reference Number | Feature |
|---|---|
| 10 | Pad |
| 11 | Top of pad |
| 12 | Note |
| 13 | Sheet |
| 14 | Back face of note |
| 15 | Front face of note |
| 16 | Adhesive portion |
| 17 | Adhesive layer |
| 18 | Non-adhesive portion |
| 20, 22 | Release corner |
| 24, 26 | Corner |
| 30 | Assembly |
| 32 | Dispenser |
| 34 | Retention Feature |
| 36 | Pillar |
| 38 | Mounting face |
| 40 | Recessed portion |
| 42 | Portion of back face of note in contact with mounting face |
| 44 | Portion of back face of note extending beyond mounting face |
| 46 | Wall segment |
| 47 | Wall opening |
| $W_H$ | Wall height |
| $P_T$ | Pad thickness |
| 334 | Retention Feature |
| 336 | Pillar |
| 338 | Mounting face |
| 339 | Proximal portion of recessed portion |
| 340 | Recessed portion |
| 341 | Distal portion of recessed portion |
| 410a, 410b, 410c, 410d,410e | Pad |
| 420, 422 | Release corner |
| 430 | Assembly |
| 446 | Wall segment |
| 447 | Wall opening |
| 448 | Wall corner |
| 450 | Wall middle portion |

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An assembly for dispensing adhesive notes comprising:

a pad comprising a plurality of adhesive notes, wherein each adhesive note in the plurality includes a sheet having a front face and a back face and an adhesive on the back face of the sheet and wherein the adhesive covers at least 75% of the surface area of the back face of the sheet; and a dispenser including a retention feature adapted to receive and secure the pad, the retention feature comprising a pillar having a mounting face and a recessed portion surrounding the pillar;

wherein the adhesive note directly adjacent to the pillar is adhered to the mounting face of the pillar and wherein a surface area of the adhesive is greater than a surface area of the mounting face, and wherein a geometric center of the adhesive is aligned over the mounting face.

2. The assembly of claim 1 wherein the sheets comprise paper.

3. The assembly of claim 1 wherein the adhesive covers at least 85 percent of the surface area of the back face of the sheet.

4. The assembly of claim 1 wherein the notes have an aspect ratio of from about 2:1 to about 1:2.

5. The assembly of claim 1 wherein the notes are substantially rectangular in shape.

6. The assembly of claim 1 wherein the surface area of the mounting face is equal to from about 15 percent to about 40 percent of the surface area of the adhesive portion of the notes.

7. The assembly of claim 1 wherein the surface area of the mounting face is equal to from about 20 percent to about 30 percent of the surface area of the adhesive portion of the notes.

8. The assembly of claim 1 wherein the dimensions of the mounting face are about 1.5 inches×1.5 inches (3.8 cm by 3.8 cm) and the dimensions of the sheets are about 3 inches by 3 inches ((7.7 cm by 7.7 cm).

9. The assembly of claim 1 wherein the height of the mounting face is at least about 0.03 inch (0.8 mm) above the level of the recessed portion.

10. The assembly of claim 1 wherein the height of the mounting face is at least about 0.06 inch (1.5 mm) above the level of the recessed portion.

11. The assembly of claim 1 wherein the height of the mounting face is at least about 0.12 inch (3 mm) above the level of the recessed portion.

12. The assembly of claim 1 wherein the retention feature comprises one or more peripheral wall segments.

13. The assembly of claim 12 wherein at least part of the one or more peripheral wall segments extends to a height at least as high above the mounting face as the thickness of the pad.

14. The assembly of claim 13 wherein at least one of the one or more peripheral wall segments is profiled to have a relatively shorter height at some portion and relatively taller height at another portion.

* * * * *